US005189896A

United States Patent [19]

Melzer et al.

[11] Patent Number: 5,189,896

[45] Date of Patent: Mar. 2, 1993

[54] SINGLE STAND ROLLER LEVELLER FOR HEAVY PLATE

[75] Inventors: Andrew E. Melzer, Bethel Park; Leonard P. Blough, Irwin, both of Pa.

[73] Assignee: Mesta International, Pittsburgh, Pa.

[21] Appl. No.: 844,120

[22] Filed: Mar. 2, 1992

[51] Int. Cl.[5] ..... B21D 1/02

[52] U.S. Cl. ..... 72/13; 72/20; 72/21; 72/165; 72/245

[58] Field of Search ..... 72/160, 164, 165, 163, 72/13, 20, 21, 245, 248

[56] References Cited

U.S. PATENT DOCUMENTS

| | | | |
|---|---|---|---|
| 2,945,530 | 7/1960 | Maust . | |
| 2,963,070 | 12/1960 | Maust . | |
| 3,466,913 | 9/1969 | Klempay et al. . | |
| 3,606,784 | 9/1971 | Schluter . | |
| 3,623,348 | 11/1971 | Thompson et al. . | |
| 3,638,326 | 2/1972 | Thompson et al. | 72/245 |
| 3,701,274 | 10/1972 | Roesch | 72/165 |
| 3,905,216 | 9/1975 | Hinrichsen | 72/13 |
| 4,152,913 | 5/1979 | Zerhoch | 72/20 |
| 4,633,697 | 1/1987 | Blough | 72/164 |
| 4,730,472 | 3/1988 | Ellis | 72/21 |

FOREIGN PATENT DOCUMENTS

| | | | |
|---|---|---|---|
| 2117489 | 10/1971 | Fed. Rep. of Germany | 72/164 |
| 60-170526 | 4/1985 | Japan . | |
| 115328 | 6/1985 | Japan | 72/160 |
| 223615 | 11/1985 | Japan | 72/163 |
| 214825 | 9/1987 | Japan | 72/164 |
| 180325 | 7/1988 | Japan | 72/13 |
| 57918 | 3/1989 | Japan | 72/160 |
| 772647 | 10/1980 | U.S.S.R. | 72/165 |

*Primary Examiner*—Daniel C. Crane

*Attorney, Agent, or Firm*—Armstrong, Westerman, Hattori, McLeland & Naughton

[57] ABSTRACT

A roller leveller for one-pass levelling of high strength metal plate comprises a main frame, top beams mounted on the main frame, three upper roll frames mounted on the top beams, a lower roll frame mounted on the main frame, three sets of upper and lower driven work rolls mounted, respectively, on the upper and lower roll frames, backup rolls backing up each work roll, four screwdown assemblies associated with each set of upper work rolls whereby they are movable as a set vertically and tiltable in the direction of a pass line of plate passed through the leveller; and control means separately to control the gap between the upper and lower work rolls in each set.

9 Claims, 4 Drawing Sheets

SINGLE STAND ROLLER LEVELLER FOR HEAVY PLATE

BACKGROUND OF THE INVENTION

1. Field of the Invention

This invention relates to levelling of heavy steel plates and especially to apparatus and methods for roller levelling of steel plates having a yield strength up to about 250,000 psi and thicknesses from about 3/16 inch to about ½ inch.

2. Prior Art

The roller levelling of heavy gauge, high strength metal plate is a very difficult operation, and typically has required the use of extremely heavy and expensive levelling equipment. Heretofore, in conventional roller levelling, in order to effectively level thick, high strength metal plate, it has been necessary either to pass the plate back and forth between the levelling rollers or to provide a plurality of roller stands through which the plate is successively passed and in each of which successive stands, the deflection between opposed upper and lower work rolls is decreased so that there is little or no bending of the plate material exiting the last such stand. In the first case, multiple reversing passes of the plate through the leveller requires upstream space at least equal to the length of the plate being levelled. In the latter case, multiple stands also require substantial space and are very expensive so as to be impractical.

Numerous prior art devices are known comprising two or more clusters of opposed upper and lower work rolls for performing two or more physical treatments of sheet or strip, such as correction of edge waves (where the edges of the sheet or strip are longer than the center portion); "oil canning" (where a center portion of the sheet or strip is longer than the edges); correction of strip "crown"; and flattening of the sheet or strip of widely varying types of products, such as relatively thin sheet and strip and heavier gauge plate wherein different roll diameters are used to level materials of different thicknesses. Examples of such prior art devices include: Blough U.S. Pat. No. 4,633,697; Thompson et al. U.S. Pat. No. 3,623,348; Thompson et al. U.S. Pat. No. 3,638,326; Roesch U.S. Pat. No. 3,701,274; Schlueter U.S. Pat. No. 3,606,784: Klempay U.S. Pat. No. 3,466,913; Maust U.S. Pat. No. 2,963,070; Maust U.S. Pat. No. 2,945,530, and Japanese Patent Publication No. 60-171526 (A).

SUMMARY OF THE INVENTION

The present invention is directed to a roller leveller comprising a single stand or main frame having a plurality of individual clusters or sets of opposed upper and lower work rolls wherein the upper and lower rolls are capable of being off-set from each other in the vertical direction and in the direction of the pass line to provide varying degrees of roll deflection and a correspondingly varying extent of bending of a plate being levelled. Normally, each successive cluster of opposed upper and lower work rolls have the same deflection setting and the plate to be levelled is passed successively through the several clusters of rolls. Such a leveller is usable in close association with a heat treatment furnace wherein the plate to be levelled is subjected to a heat treatment and immediately is passed from the furnace into the leveller at elevated temperature so that, if desired, a part of the heat treatment can be continued in the leveller.

Provision of at least two, and preferably three, roll clusters or sets enables the leveller of the invention to handle extremely large roll separating forces, on the order of 7.5 million pounds. For example, with three individual roll clusters, each roll cluster is subjected to a roll separating force of 2.5 million pounds. Contrary to conventional roller levelling, in which each pass through a set of rolls would entail successively lighter roll deflections and plate bending, in the present invention each roll cluster has the same deflection varying from greatest deflection at an entry roll pair to a least deflection at an exit roll pair. In such manner, each roll cluster bears an equal share of the total roll separating force and the leveller thus is capable of handling the large forces involved.

By provision of a pair of pinch rolls upstream of the first cluster of work and backup rolls, actual plate thickness is determined and compared to a scheduled thickness and adjustment of the roll deflection is made accordingly. Further, by means of pressure transducers and switches, actual roll separation force is determined and compared with a scheduled force and adjustment of roll deflection is made accordingly. Plate temperature also is determined as a plate is ready for entry into the leveller. Any temperature deviation from scheduled temperature is used to correct calculation of the required roll deflection setting.

DESCRIPTION OF THE PREFERRED EMBODIMENT

Figure 1:
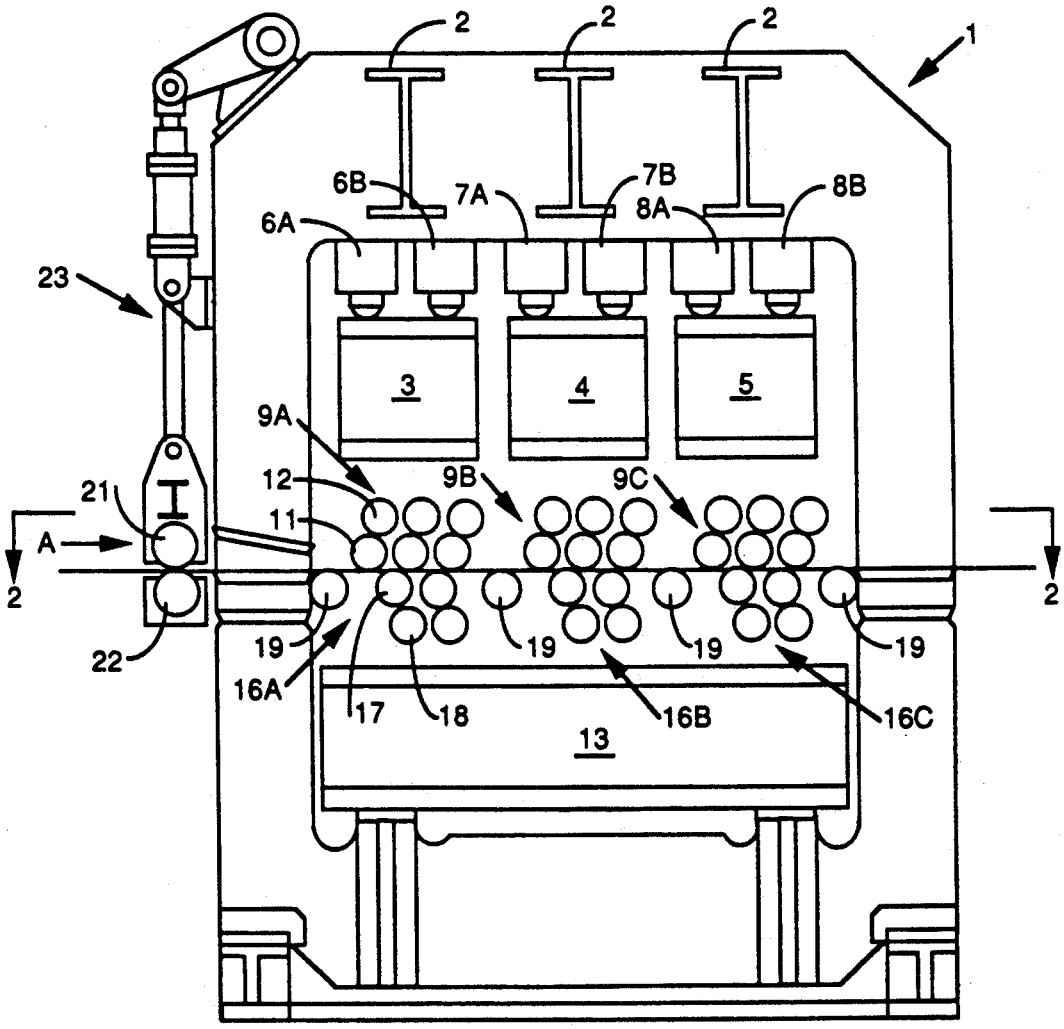
FIG. 1 is a side elevation of the roller leveller stand in accordance with this invention.

Considering, first, FIG. 1, the numeral denotes generally a main frame upon which are mounted top beams 2. Mounted on top beams 2 are a plurality of upper roll frames, preferably three in number, denoted respectively by the numerals 3, 4 and 5. Each of the upper roll frames is of generally rectangular shape. Bearing on a corner portion of each upper roll frame is a screwdown device, preferably a hydraulic cylinder/piston assembly. These assemblies are numbered 6A-D, 7A-D, and 8A-D, but only two are shown for each upper roll frame as illustrated in FIG. 1, i.e. numbers 6A and 6B, 7A and 7B, and 8A and 8B. It is to be understood that there is a similar assembly on each of the other two corners of each upper roll frame. Thus the lower ends of the pistons in each of the cylinder/piston assemblies bears on a corner of an upper roll stand whereby the roll stand can be moved in a vertical direction and also tilted in the direction of a pass line A (FIGS. 1 and 2) of plate passed through the leveller.

Mounted on each upper roll frame are individual groups of upper work rolls 11 and upper backup rolls 12, forming three clusters of upper rolls 9A, 9B and 9C.

Mounted on the main frame 1 is a lower roll frame 13 on which are mounted lower work rolls 17 and lower backup rolls 18, in three clusters 16A, 16B and 16C, respectively opposed to upper roll clusters 9A, 9B and 9C.

Carrier rolls 19 are also mounted on the lower roll frame in positions upstream of the first roll cluster, between roll clusters and downstream of the final roll cluster.

A pair of pinch rolls 21, 22 are provided upstream of the first roll cluster. The upper pinch roll 21 is vertically moveable against a pinch roll cylinder/piston assembly denoted generally by the numeral 23.

Figure 2:
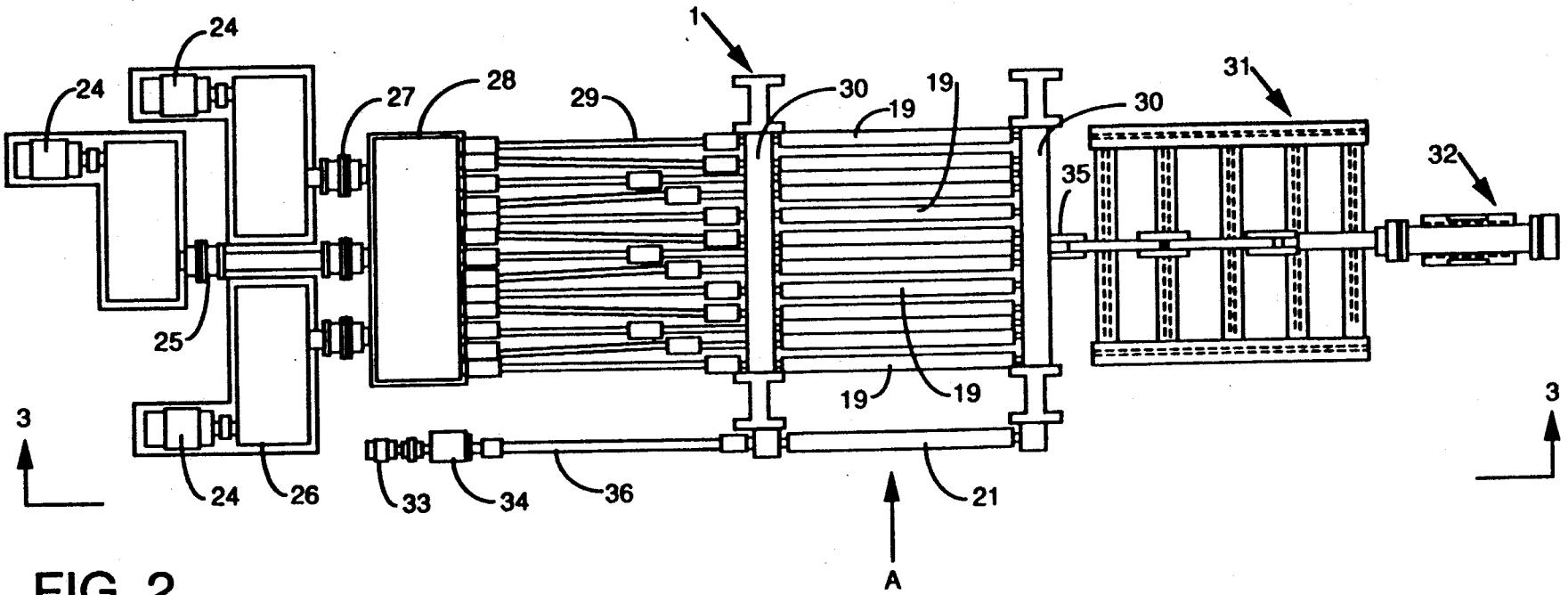
FIG. 2 is a plan view of the roller leveler taken along line 2—2 of FIG. 1.

As shown in FIG. 2, each of the work rolls 11 and 17, and the carrier rolls 19 are driven, by motors 24, through coupling 25, a gear reducer 26, couplings 27, a pinion stand 28, and drive shafts 29. The pinch rolls also are driven, by motor 33, through gear reducer 34 and drive shafts 36. The upper and lower backup rolls 12 and 18, respectively, are idler rolls and, as shown in FIG. 3, are of much shorter length than the work rolls 11 and 17 in order to provide high backup force along the lengths of the work rolls.

The work rolls are internally cooled by a recirculating water system (not shown). Water normally is continually circulated and flow is activated and deactivated by means of a programmed personal computer interface. Appropriate alarms may be displayed or sounded for overly high temperature or too low water flow.

Figure 3:
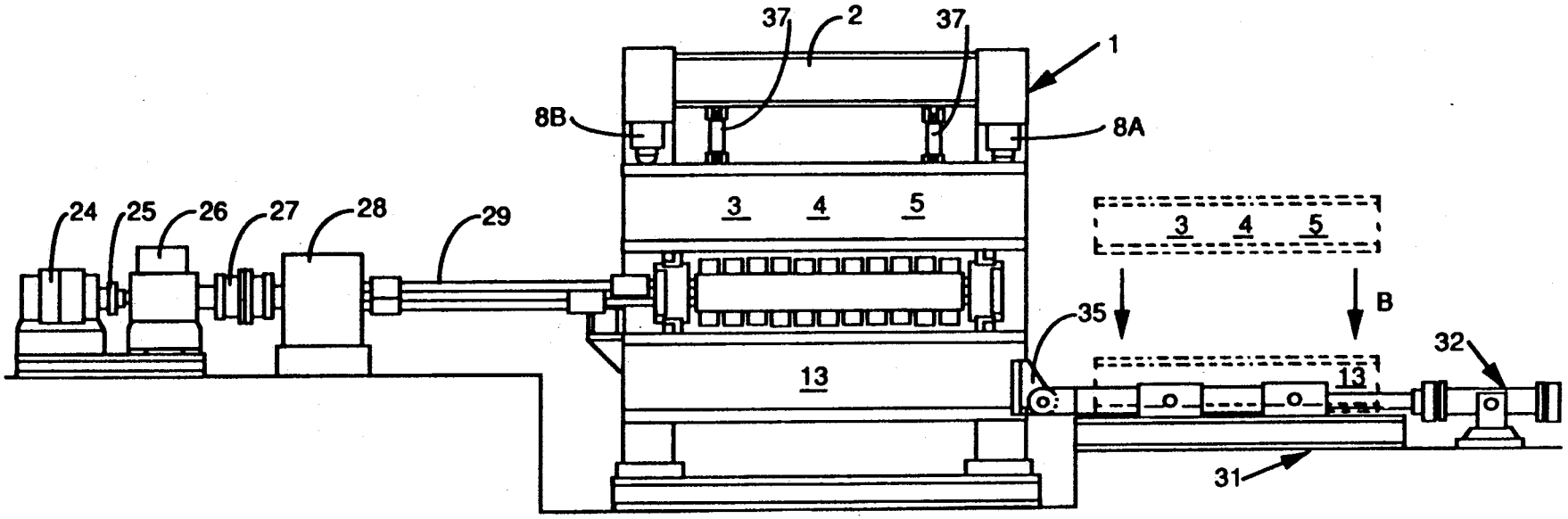
FIG. 3 is a side elevation of the roller leveller of the invention, taken along line 3—3 of FIG. 2.

As shown in FIG. 3, balance cylinders 37 are mounted on the top beams 2 and support the weight of an upper carriage comprising upper roll frames 3, 4 and 5 and maintain the upper carriage in contact with the hydraulic screwdown mechanisms. There are two such balance cylinders per upper roll frame, for a total of six such cylinders.

As also shown in FIGS. 2 and 3, the leveller is provided with a roller table 31 and a roll removal and replacement hydraulic cylinder/piston assembly denoted generally by the numeral 32. Connector pins (not shown) in the balance cylinders can be removed, thereby lowering the upper carriage, in the direction of arrow B (FIG. 3) onto spacers mounted on the lower carriage comprising the lower roll frame. The two carriages then are removable together from the main frame 1 to the roller table 31 by connection to and retraction of the cylinder/piston assembly 32, e.g. by through a pivoted connector 35.

Figure 4:
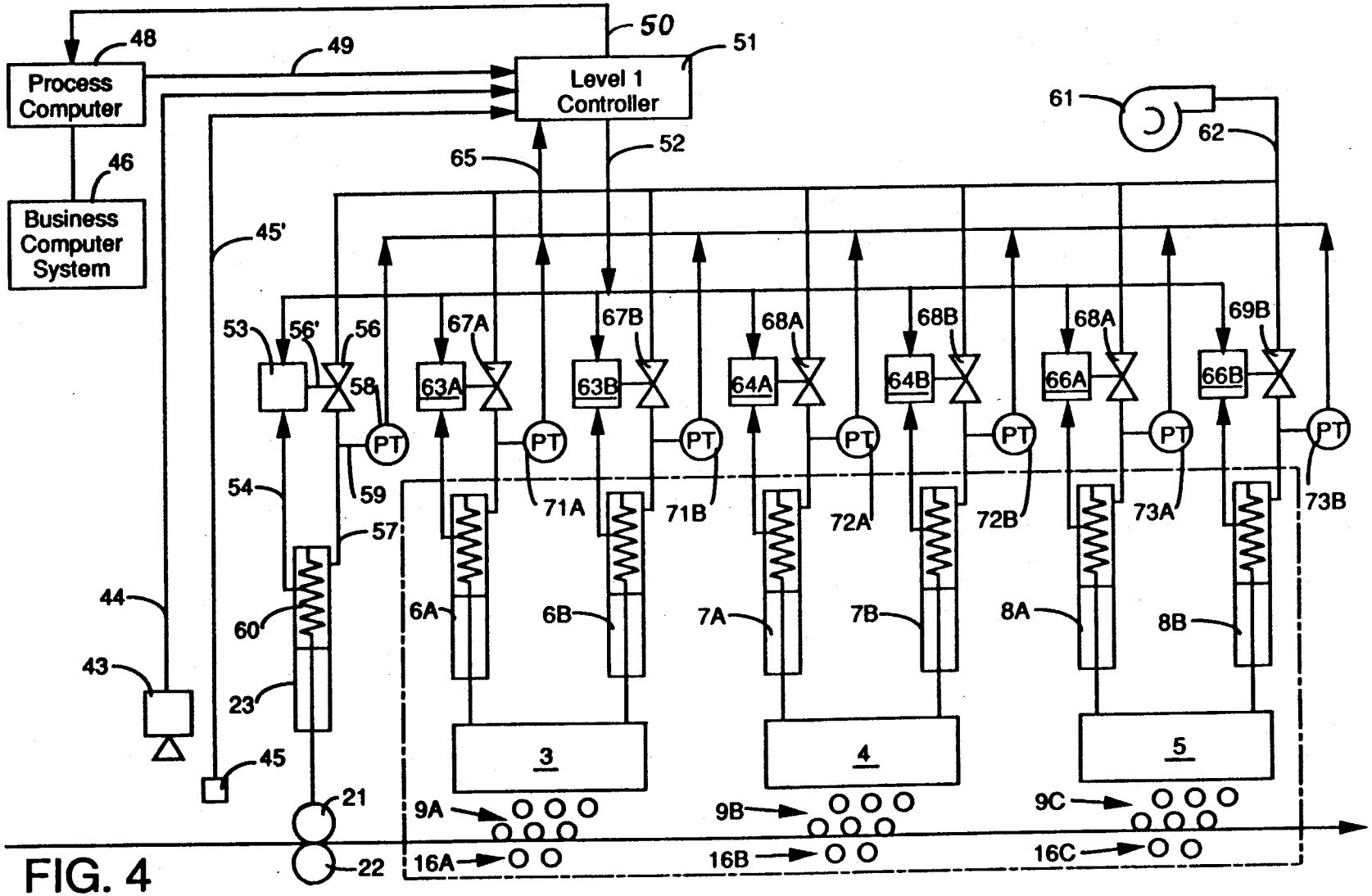
FIG. 4 is a block diagram illustrating the control mechanisms of the roller leveller and its operation.

Referring next to FIG. 4, it will be seen that the pinch-roll-associated cylinder/piston assembly 23 is provided with a piston position detector 60 by means of which a position signal can be transmitted, through line 54, to a gap (roll deflection) position controller 53 which is connected, through line 52, to a level 1 controller 51 which in turn is connected, through line 50, to a process computer 48 which receives scheduling information from a business computer 46. By such mechanism, plate thickness (as well as plate length—determined by the number of rotations of the pinch rolls while a plate passes therethrough) information is transmitted to the process computer. Actual thickness information, so determined, is compared to the thickness scheduled for the particular plate—received by the process computer from the business computer—and correction thereby made for the thickness factor in the calculation carried out by the process computer. A pressure transducer 58 is connected through line 57 to the cylinder of cylinder/piston assembly 23 to measure actual pressure in the cylinder. Pressure transducer 58 also is connected, through line 59, to a servo valve 56 which is connected, through line 62, to a pressurizable source 61 of hydraulic fluid. By such means, actual pressure is compared with scheduled pressure (corresponding to plate gauge and roll deflection setting for the particular plate of specified composition, hardness, width, and temperature). Pressure information from transducer 58 is transmitted, through line 65, to the level 1 controller 51 interface (a PC-based computer primarily used for programming and maintenance) and then to the process computer where the information is handled as the actual force for recalculation of necessary gap settings based on the corrected actual pressure. Any necessary gap setting correction signals are transmitted to the gap position controller 53 and, through line 56', to servo valve 56.

Each of the roll frame-associated cylinder/piston screwdowns 6A–6D, 7A–7D and 8A–8D is provided with similar piston position detector 60; gap position controller 63A-B, 64A-B, and 66A-B (each position controller controls two cylinder/piston assemblies—an entry pair and an exit pair); pressure transducer 71A-D, 72A-D and 73A-D; servo valve 67A-D, 68A-D, and 69A-D, and corresponding electrical signal lines and hydraulic lines. In FIG. 4 only two of the cylinder/piston assemblies for each roll frame are shown, but it is to be understood that the other assemblies are similarly equipped.

As also shown in FIG. 4, an optical pyrometer 43 is provided ahead of the pinch rolls 21, 22. The pyrometer 43 is connected through line 44 to controller 51 which, through line 50, can send temperature signals back to the process computer 48.

Downstream of the pyrometer and upstream of the pinch rolls there is located a photocell 45, connected through line 45' to the controller 51. The photocell 45 signals the arrival and departure of each plate and, for example, facilitates making any necessary changes in the rolling parameters within the allowable time from entry of the plate in the photocell zone to its arrival in the pinch rolls or the first roll cluster.

Thus, when the photocell detects the arrival of a plate, a signal is sent to the controller 51 and when the pinch roll position indicates through the pressure transducer 58 that a certain pressure exists, then such actual gap information is sent to the process computer 48 where roller gap settings for the clusters is calculated and a corresponding signal is sent to the controller 51. From controller 51 a position set point signal is sent to the gap position controllers 63A and 63B, 64A and 64B, and 66A and 66B. The latter then actuate the hydraulic cylinder/piston assemblies 6A-D, 7A-D, and 8A-D though corresponding servo valves 67A-D, 68A-D and 69A-D. At the same time the pressure transducers 71A-D, 72A-D, and 73A-D are feeding back pressure information to controller 51 for comparison with the calculated values and adjustment of the gap settings if necessary.

In the normal operation of the leveller according to the foregoing construction, the plate levelling schedule in the process computer contains primary data for each plate scheduled to be levelled comprising: an identification of the particular plate; steel grade; expected temperature; plate width, thickness and hardness; work roll diameter, and rolling speed.

As each plate enters the soak zone in the heat treating furnace, measured temperature is entered as primary data in the process computer 48. As the plate leaves the furnace, plate temperature is measured by the optical pyrometer 43, averaged over the plate length and stored in the controller 51 for transmission to the process computer 48 which then uses this averaged temperature for calculation of gap setting.

The pinch rolls are set to a rest position providing a gap of several inches. When photocell 45 detects a plate, the controller 51 lowers the pinch rolls 21, 22 to a position slightly less than the thickness of the plate to be levelled and monitors the hydraulic pressure in the pinch roll cylinder 23. This procedure prevents possible equipment damage due to a possibly upturned leading edge of the plate.

Position transducer 60 associated with pinch rolls 21, 22 determines the actual plate thickness by measuring the distance the pinch rolls are spread apart. A rotary encoder (not shown) determines the revolutions made by the pinch rolls while engaged with the plate to determine the plate length. Plate thickness and length are stored in the controller 51 for transmission to the process computer 48.

When the thickness measurement of the plate has been made, the thickness, plate temperature and the time that the temperature was taken are transmitted by the controller 51 to the process computer 48 for calculation of the roll gap settings to be made for the plate. The process computer 48 then utilizes the following primary data: plate identification; steel grade; actual plate temperature; time the temperature was taken; variance from furnace soak zone temperature; plate width; actual plate thickness; variance from expected plate thickness; plate relative hardness; roll diameter, and rolling speed to calculate roll gap settings. As previously stated, the actual temperature is the average detected by pyrometer 43 over the length of the plate. Time temperature is taken is when the temperature sensed by the pyrometer first rises above ambient temperature and stabilizes. The computer model adjusts this temperature with a decay factor to allow for cooling after the time the temperature was taken. From such data, the computer calculates the following model results: cluster 1, 2, 3 calculated entry gap; cluster 1, 2, 3 calculated exit gap, and cluster 1, 2, 3 expected roll separating force.

The photocell 45 and the rotary encoder (not shown) at the pinch rolls 21, 22 are used to determine the actual plate length. When the plate exits the pinch rolls, this information is transmitted to the process computer. Then the actual force on the cylinders at each roll cluster is used to determine when the plate is entering and exiting each of the roll clusters. In cases where the roll balance pressure is greater than that required to level the plate, roll r.p.m. can be used to calculate plate entry to and exit from the cluster. When a plate exits a cluster, that cluster opens to the "rest" position unless a new roll gap setting is made.

The hydraulic cylinders allow a vertical movement of 3 inches in 15 seconds. The pinch rolls are located about 4 feet ahead of the first roll cluster. The maximum plate speed is about 1.46 inches per second. This allows a minimum of about 33 seconds to position the first roll cluster from the time the plate contacts the pinch rolls until it arrives at the first cluster. Accordingly, gap setting data is transmitted from the process computer 48 to the controller 51 sufficiently ahead of the required time before the plate arrives at the first cluster to allow the associated cylinder/piston assembly to travel full stroke.

Control of position of the cylinder/piston assemblies associated with the roll frames 3, 4 and 5 is accomplished with use of linear positioning modules. These are intelligent I/0 modules each of which contains a microprocessor and controls the position of one pair of cylinders with each cylinder being controlled independently of the other. The module runs a proportional integral derivative (PID) algorithm for closed loop control with a cycle time of two milliseconds.

As above described, the pressure at each hydraulic cylinder/piston assembly associated with the upper roll frames is monitored by a pressure transducer. The output of the four pressure transducers in each roll cluster is periodically totaled and stored in the level 1 controller 51 interface. Each time a peak force is measured it is transmitted to the process computer 48 where it is handled as the actual force in the gap setting calculation. If the actual total pressure deviates from the expected force by more than 5%, an alarm is sounded on the process computer interface. If unsafely high pressure is detected by any of the pressure detectors, the system immediately releases the pressure on the overloaded cluster.

The upper and lower roll frames are adjustable in the vertical direction for roll wear by means of a sliding wedge arrangement (not shown). To "zero" the leveller to compensate for roll wear, a flat plate of known thickness is moved into a roll cluster. The plate thickness is entered on the computer terminal and a "zero" sequence is initiated. The system contracts the cluster from the "rest" position to contact the plate while monitoring the pressure at each hydraulic cylinder associated with the particular roll frame. When the cylinder pressure rises to a predetermined value, the piston stops. When all four pistons have reached their final positions, the system indicates that it is ready to be reset. The reset function then is initiated and the system reads the current position of each of the four cylinders and subtracts the plate thickness. This value is stored as the "zero" position of each cylinder/piston assembly, and the system controls the piston positions relative to this "zero" position.

We have found that, to effectively level steel plate having high yield strength on the order of 250,000 psi, it is necessary to have a heavy "bite," that is, a high roll deflection in which at least 50% of the plate section is stressed to the yield point; the balance of the plate section remains in the elastic state. This is done in each of the several roll clusters, e.g. the three clusters in the preferred embodiment disclosed above. In this way there is provided the equivalent of multiple passes, e.g. in a reversing leveller, but all in one direction in a single leveller stand. This is in contrast to conventional roller levellers in which, when multiple passes are required, a reversing operation is carried out.

We also have found that, to roll such high strength metals of thickness up to about ½ inch, it is necessary to use work roll diameters of at least about 7 inches.

These important roller levelling criteria are illustrated in Tables 1 and 2 in which the following steel plate characteristics were common to both cases:

width = 115 inches
yield strength = 246,000 psi
modulus of elasticity = $30 \times 10^6$
temperature = 80 deg. F.

TABLE 1

| Roll characteristics: |
|---|
| number of top work rolls: 3 |
| number of bottom work rolls: 2 |
| pitch: 8.5 inches |

TABLE 1-continued work roll diameter: 7 inches

| Plate Thick. In. | Total Roll Separating Force, Lbs. | Percent of Plate Section Stressed to Yield Point | Roller Gap Settings: First entry roller gap setting, In. | Roller Gap Settings: Last delivery roller gap setting, In. |
|---|---|---|---|---|
| 0.188 | 341,162 | 62.4 | −0.460 | 0.188 |
| 0.250 | .626,390 | 50.0 | −0.354 | 0.250 |
| 0.313 | 975,904 | 50.0 | −0.168 | 0.313 |
| 0.375 | 1,403,122 | 50.0 | −0.023 | 0.375 |
| 0.438 | 1,908,027 | 50.0 | 0.097 | 0.438 |
| 0.500 | 2,490,624 | 50.0 | 0.202 | 0.500 |

TABLE 2

Roll characteristics:
number of top work rolls: 6
number of bottom work rolls: 5
pitch: 4 inches
work roll diameter: 3.5 inches

| Plate Thick. In. | Total Roll Separating Force, Lbs. | Percent of Plate Section Stressed to Yield Point | Roller Gap Settings: First entry roller gap setting. In. | Roller Gap Settings: Last delivery roller gap setting, In. |
|---|---|---|---|---|
| 0.188 | 2,045,320 | 27.7 | −0.137 | 0.188 |
| 0.250 | 3,944,393 | 20.8 | −0.073 | 0.250 |
| 0.313 | 5,983,644 | 20.0 | 0.045 | 0.313 |
| 0.375 | 8,606,800 | 20.0 | 0.154 | 0.375 |

Table 1 shows roller gap settings for one of three clusters of rolls in accordance with the invention. Normally the gap setting is the same for all three clusters. From Table 1 it is seen that, at a roll separating force of about 2.5 million pounds for the one roll cluster, the total separating force for all three clusters would be about 7.5 million pounds and, at such separating force, plate having the noted physical properties can be roller levelled in thicknesses up to 0.5 inch. Under the conditions of Table 1, the percent of the plate section which is stressed to the yield point is at least 50%. On the other hand, from Table 2, representing a conventional single pass levelling operation, it is seen that, at a roll diameter of 3.5 inches, and a percent of plate section stressed to the yield point of only around 20%, it is not possible to roll plate over about 0.375 inch and even at such low thickness the roll separating force is over 8.6 million pounds.

In contrast to a conventional leveller, where, if the single cluster of rolls is inoperative, the entire leveller would be out of operation, in the leveller of this invention, if, for any reason, one roll cluster is inoperative, the leveller can be operated with the other roll clusters, each of which would be capable of handling the full roll cluster force, e.g. 2.5 million pounds in the example of Table 1.

What is claimed is:

1. A roller leveller for one-pass levelling of high strength steel plate having a yield strength up to about 250,000 psi and a thickness from about 3/16 to about ½ inch, comprising:

a main leveller frame;

top beams mounted on the main frame;

at least three generally rectangular upper roll frames mounted on the top beams;

a lower roll frame mounted on the main frame;

at least three sets of separately driven upper work rolls and lower work rolls, each upper work roll mounted in an upper roll frame and moveable therewith and each lower work roll mounted in the lower roll frame, wherein one set of opposed upper and lower rolls comprises an entry roll set, another set of opposed upper and lower rolls comprises an intermediate roll set and another set of opposed upper and lower rolls comprises an exit roll set, each roll set comprising at least three upper work rolls opposed to at least two lower work rolls of the same diameter, said upper and lower work rolls of each set being offset relative to one another so as to level said plate as the plate is fed through the work rolls along a horizontal path;

back-up rolls backing up each work roll;

at least twelve screwdown assemblies, each said assembly having a pusher element thereof bearing on a corner portion of an upper roll frame whereby, by selective operation of said assemblies, the corresponding upper roll frame and its associated rolls are moveable vertically and are tiltable in the direction of a pass line of plate passed through the leveller to vary the gap between the upper and lower work rolls, all of said upper roll frames being tiltable and vertically movable;

retraction actuation means to actuate selective ones of said assemblies to vertically move the corresponding upper roll frame and associated upper rolls as a single group into and out of an operative position;

driven carrier rolls upstream of the entry roll set, downstream of the exit roll set, and between each roll set, said carrier rolls acting as non-shaping rolls;

means separately to drive each work roll and the carrier rolls;

a pair of opposed and vertically spaced apart pinch rolls disposed upstream of the entry roll set in the pass line of plate passed through the leveller;

control means separately to control the gap between upper work rolls and lower work rolls in each set of work rolls in a vertical direction and in the direction of the pass line, and means to remove the rolls from the respective roll frames.

2. A roller leveller according to claim 1, wherein the work rolls have a diameter of at least about 7 inches.

3. A roller leveller according to claim 1, wherein the screwdown assemblies are hydraulic cylinder/piston assemblies and the leveller includes a pressurizable source of hydraulic fluid connected to the cylinders of the respective assemblies.

4. A roller leveller according to claim 3, wherein said pair of pinch rolls is located upstream of a first set of work rolls.

5. A roller leveller according to claim 4, further comprising a hydraulic cylinder/piston assembly and a piston position detector operatively connected to the upper pinch roll to determine the position of that roll and thereby the thickness of a plate passing through the pinch rolls, said position detector generating a position signal, and means to transmit said position signal to a computer for use in calculating work roll gap settings.

6. A roller leveller according to claim 5, further comprising a pressure detecting means operatively connected to the cylinder of the cylinder/piston assembly associated with the pinch rolls to detect the pressure in said cylinder and thereby determine the roll separating force applied to the pinch rolls, said pressure detecting means generating a pressure signal, and means to transmit said pressure signal to a computer for use in calculating work roll gap setting.

7. A roller leveller according to claim 6, further comprising a photocell located upstream of the pinch rolls to detect the arrival of a plate at the leveller.

8. A roller leveller according to claim 7, further comprising an optical pyrometer located upstream of the photocell to measure the temperature of a plate approaching the leveller, said pyrometer generating a temperature signal, and means to transmit said temperature signal to a computer for use in calculation of work roll gap settings.

9. A roller leveller according to claim 8, further comprising:

a pressure detector operatively connected to the cylinder of each cylinder/piston assembly associated with each upper roll frame for generating a signal corresponding to the measured pressure in each said cylinder corresponding to the roll separating force at the corresponding set of opposed work rolls;

means to transmit said pressure signal to a computer for use in calculating work roll gap settings;

a position detector operatively connected to the piston of each such cylinder/piston assembly for generating a signal corresponding to the measured position of each such position;

means to transmit said position signal to a computer for use in calculating work roll gap settings;

a servo valve connected to the source of hydraulic fluid and to the corresponding pressure detector and position detector associated with each of the upper roll frames, and means to actuate said servo valves to position the corresponding cylinder/piston assemblies and correspondingly to position the respective roll frames and the associated work rolls in a vertical direction and in the direction of a pass line of plate passed through the leveller.

* * * * *